US007731192B1

(12) United States Patent
Marhefka

(10) Patent No.: US 7,731,192 B1
(45) Date of Patent: Jun. 8, 2010

(54) BALANCING PUZZLE

(76) Inventor: Matthew D. Marhefka, 4483 Foothill Dr., Doylestown, PA (US) 18902

( * ) Notice: Subject to any disclaimer, the term of this patent is extended or adjusted under 35 U.S.C. 154(b) by 0 days.

(21) Appl. No.: 12/287,674

(22) Filed: Oct. 10, 2008

Related U.S. Application Data

(60) Provisional application No. 60/998,395, filed on Oct. 10, 2007.

(51) Int. Cl.
*A63F 9/00* (2006.01)

(52) U.S. Cl. ..... 273/157 R; 273/156; 273/450

(58) Field of Classification Search ..... 273/153 R, 273/157 R, 156, 153 P, 154, 449, 450; D21/399; 446/325, 326, 396, 117, 118
See application file for complete search history.

(56) References Cited

U.S. PATENT DOCUMENTS

| | | | | | |
|---|---|---|---|---|---|
| 2,569,107 | A | | 9/1951 | Johnson | |
| 2,694,265 | A | | 11/1954 | Way | |
| 2,932,745 | A | * | 4/1960 | Gotting et al. | 446/87 |
| 3,863,918 | A | * | 2/1975 | Kramer | 273/450 |
| 3,881,731 | A | * | 5/1975 | Droney | 273/291 |
| 4,167,823 | A | * | 9/1979 | Kumming | 273/156 |
| 4,197,669 | A | * | 4/1980 | Hynes | 446/125 |
| 4,293,128 | A | * | 10/1981 | Ebel | 273/450 |
| 4,308,016 | A | | 12/1981 | White | |
| 4,877,407 | A | * | 10/1989 | du Pont et al. | 273/450 |
| 4,902,010 | A | * | 2/1990 | Davis et al. | 273/450 |
| 5,040,797 | A | | 8/1991 | Dykstra | |
| 5,067,729 | A | * | 11/1991 | Hunter et al. | 273/450 |
| 5,405,135 | A | | 4/1995 | Embro | |
| 5,611,544 | A | * | 3/1997 | Grebler et al. | 273/450 |
| 5,628,513 | A | | 5/1997 | Soriano | |
| 5,714,212 | A | | 2/1998 | Nissim et al. | |
| D392,692 | S | * | 3/1998 | Windom | D21/389 |
| 5,868,388 | A | * | 2/1999 | Wood et al. | 273/157 R |
| 5,928,052 | A | | 7/1999 | Buscher | |
| 6,022,026 | A | * | 2/2000 | Johnson, III | 273/450 |
| 6,164,654 | A | * | 12/2000 | Tricomi | 273/450 |
| 2005/0093244 | A1 | * | 5/2005 | Olsen | 273/450 |
| 2009/0045580 | A1 | * | 2/2009 | Donegan et al. | 273/447 |

* cited by examiner

*Primary Examiner*—Steven Wong
(74) *Attorney, Agent, or Firm*—Norman E. Lehrer

(57) ABSTRACT

The construction and balancing puzzle of the present invention utilizes multiple differently shaped parts which are assembled vertically on a stand to form particular designs. During the assembling or construction, the assembled parts must be balanced at all times. The basic puzzle piece is an injection molded cube and the remaining puzzle pieces are fabricated by joining several cubes together in a single plane. The stand or base includes a flat bottom to be supported on a table and the upper portion is made from two upwardly facing walls that are at an angle of 90 degrees with respect to each other to form a V. Each of the two walls of the base has a length that is preferably one and one-half times the length of the cube that makes the basic puzzle piece.

4 Claims, 5 Drawing Sheets

BALANCING PUZZLE

CROSS-REFERENCE TO RELATED APPLICATION

This application claims the benefit of U.S. Provisional Patent Application Ser. No. 60/998,395, filed Oct. 10, 2007.

BACKGROUND OF THE INVENTION

The present invention is directed toward a puzzle and, more particularly, toward a construction and balancing puzzle that utilizes multiple differently shaped parts which are to be assembled vertically on a stand to form particular designs. During the assembling or construction, the assembled parts must be balanced at all times.

SUMMARY OF THE INVENTION

The construction and balancing puzzle in the preferred embodiment of the invention utilizes multiple differently shaped parts which can be assembled vertically on a stand to form particular designs. During the assembling or construction of the puzzle pieces, the assembled parts must be balanced at all times. The basic puzzle piece is an injection molded cube and the remaining puzzle pieces are fabricated by joining several cubes together in a single plane. The stand or base includes a flat bottom to be supported on a table and the upper portion is made from two upwardly facing walls that are at an angle of 90 degrees with respect to each other to form a V. Each of the two walls of the base has a length that is preferably one and one-half times the length of the cube that makes the basic puzzle piece.

BRIEF DESCRIPTION OF THE DRAWINGS

For the purpose of illustrating the invention, there is shown in the accompanying drawings, one form that is presently preferred; it being understood that the invention is not intended to be limited to the precise arrangements and instrumentalities shown.

DETAILED DESCRIPTION OF THE PREFERRED EMBODIMENTS

Figure 1:
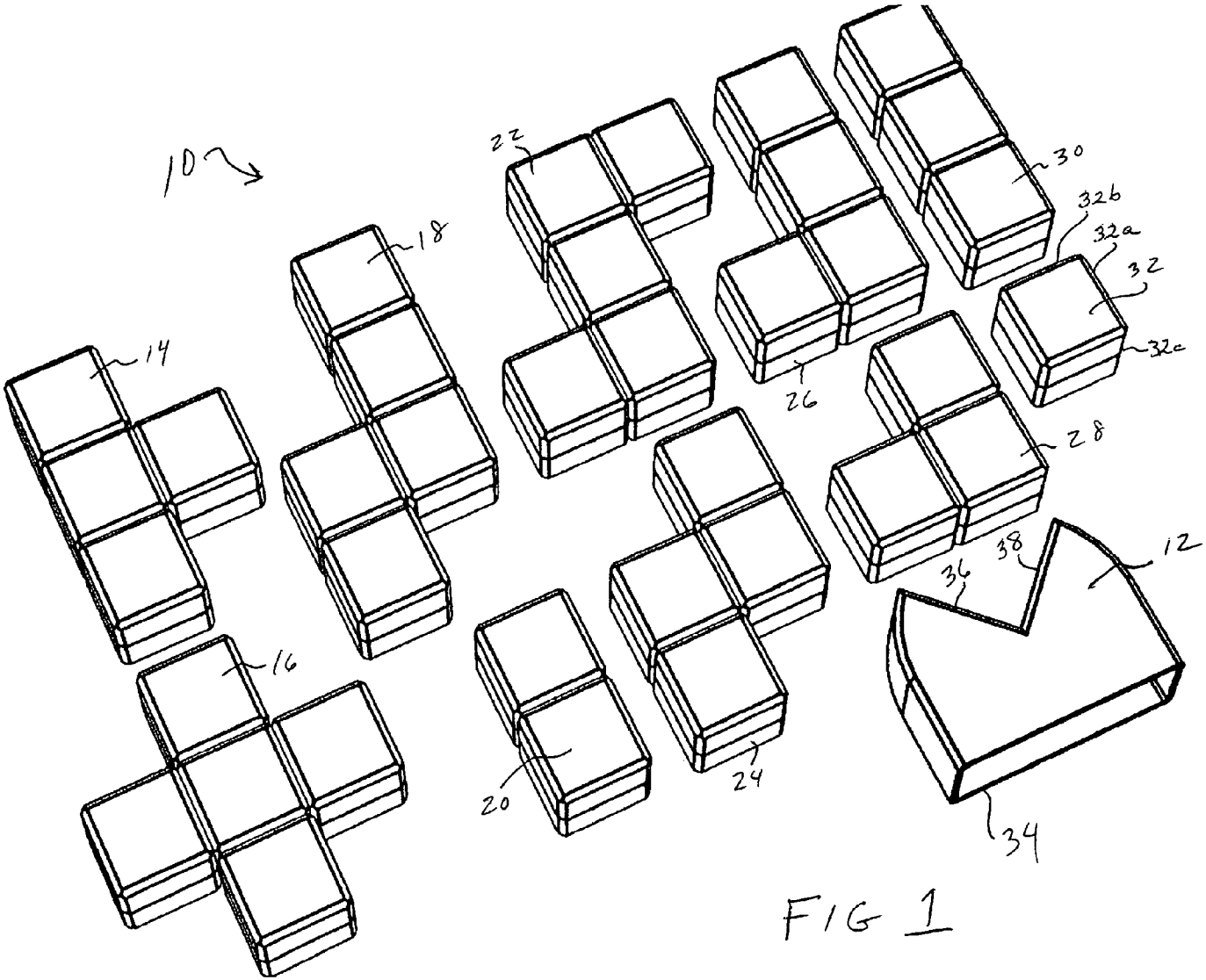
FIG. 1 is a front perspective view of the various component parts of the inventive puzzle.

Referring now to the drawings in detail wherein like reference numerals have been used throughout the various figures to designate like elements, there is shown in FIG. 1 a construction and balancing puzzle in accordance with the principles of the present invention and designated generally as 10. The puzzle 10 is comprised of several parts including a base 12 and puzzle components 14-32.

Figure 2:
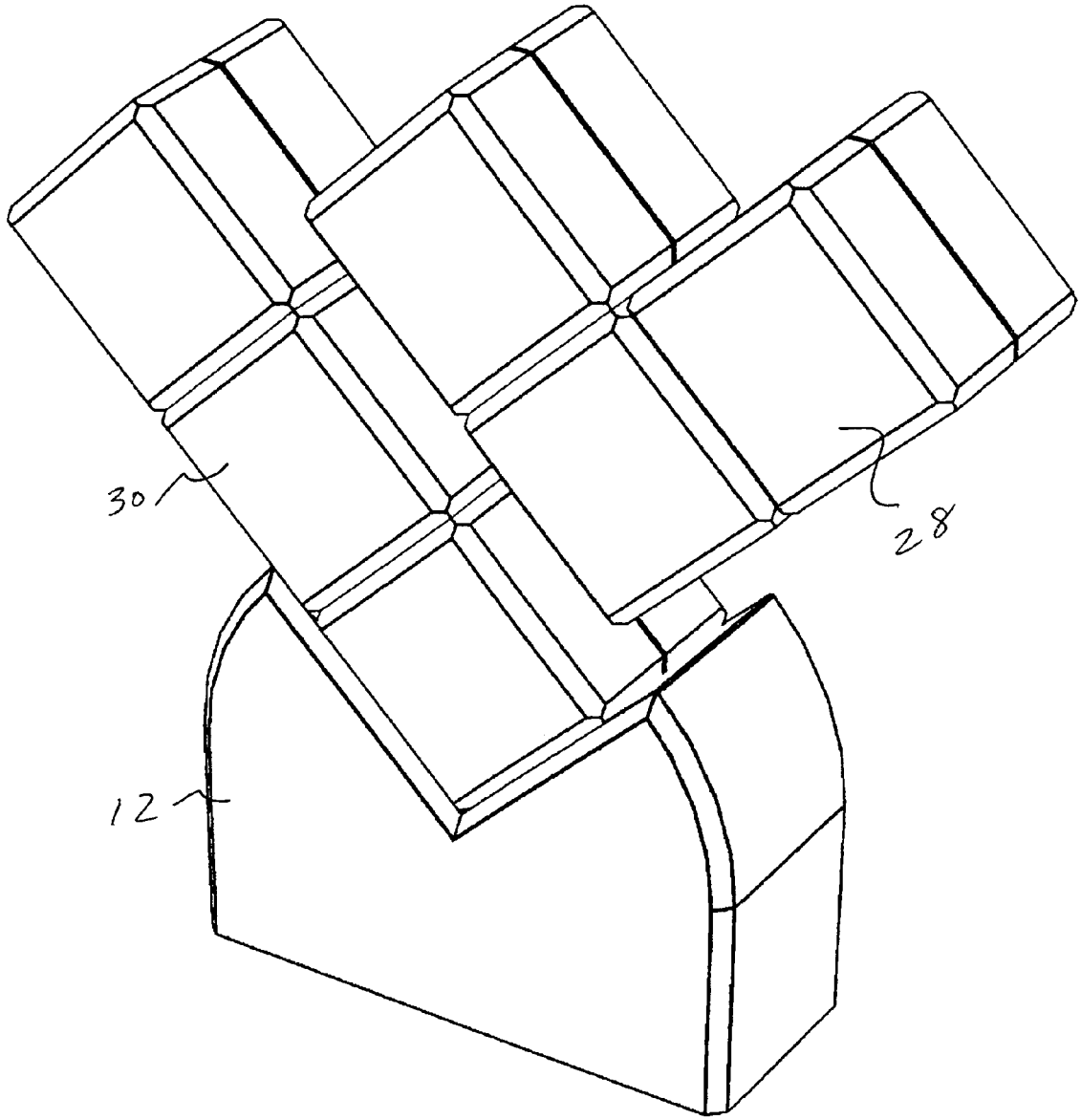
FIG. 2 is a perspective view illustrating how the various parts are being assembled.
Figure 3:
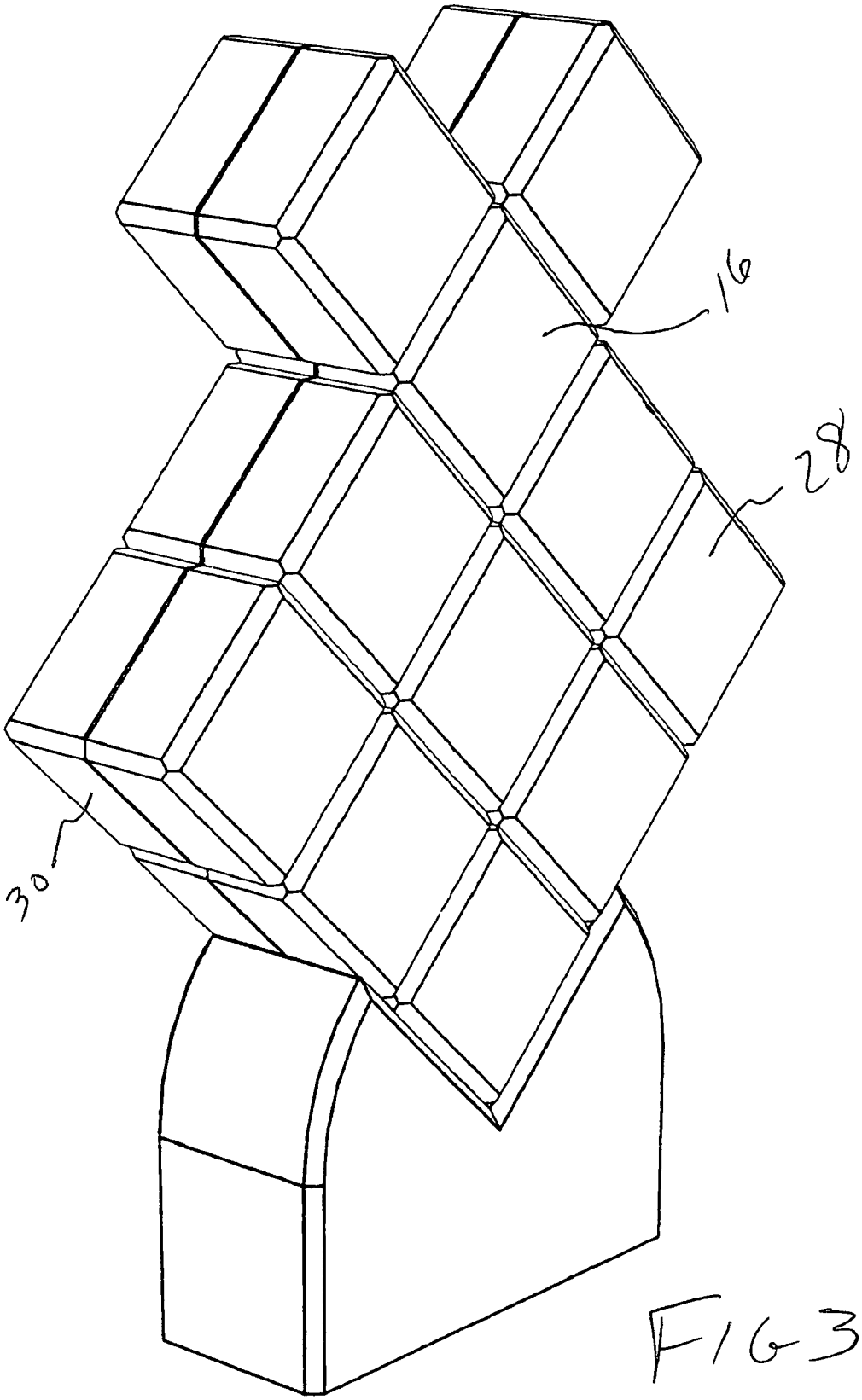
FIG. 3 is a perspective view similar to FIG. 2 showing the next step in assembling the various parts.
Figure 5:
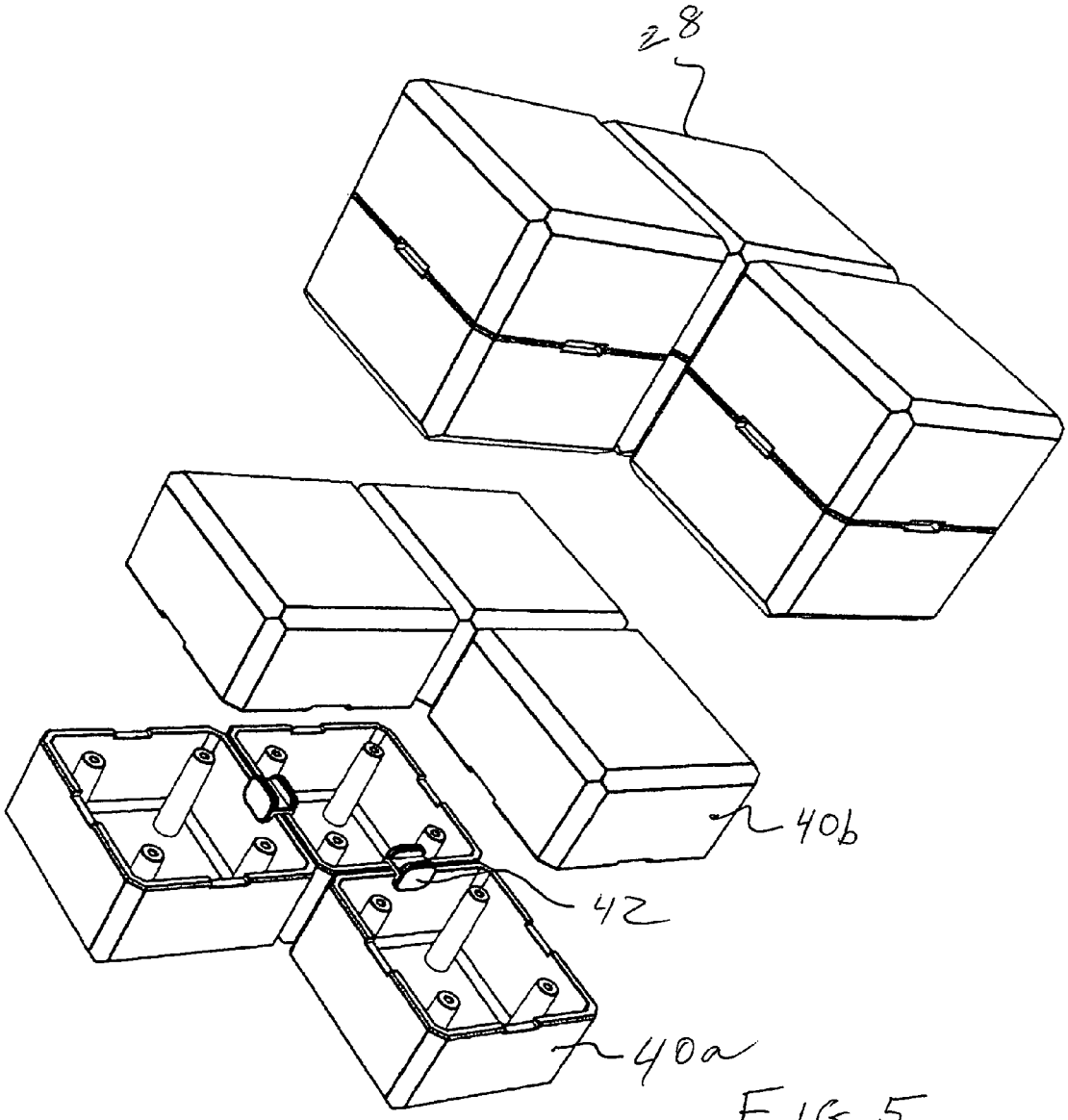
FIG. 5 is a perspective, partially exploded, view illustrating how the various parts are being assembled.

As shown more clearly in FIGS. 2, 3 and 5, the puzzle components 14-32 are comprised of cubes that are attached together. That is, in the preferred embodiment, the depth, height and width of each of the portions of the puzzle elements are equal. Note in particular, element 32. Thus, each of the puzzle components can be considered to be a single cube or multiple cubes secured together in different shapes. In all cases, however, it is preferred that all of the cubes in each of the puzzle components lie in a single plane. That is, while there is clearly a single depth to each of the puzzle components, the cubes are connected together in only two planes. Thus, the various puzzle pieces (other than piece 32) can be considered to be a piece 32 with legs or arms extending therefrom in one or two dimensions.

Although the shape of the puzzle piece 32 is described as a cube, it should be readily apparent that it need not be exactly a cube. That is, the invention will also be functional as long as the face of each "cube" is a square. The thickness or depth could possibly be greater or less than the length or width. With respect to puzzle piece 32, for example, the length 32*a* and width 32*b* should be the same size so as to create a square. The thickness or depth 32*c*, however, can be the same size so as to form a true cube or it could be somewhat greater or smaller. Of course, and as will become apparent, the depth 32*c* must be great enough that the pieces be able to stand thereon. The remaining puzzle pieces 14-30 will have the same depth size as the depth 32*c* of the puzzle piece 32.

Figure 4:
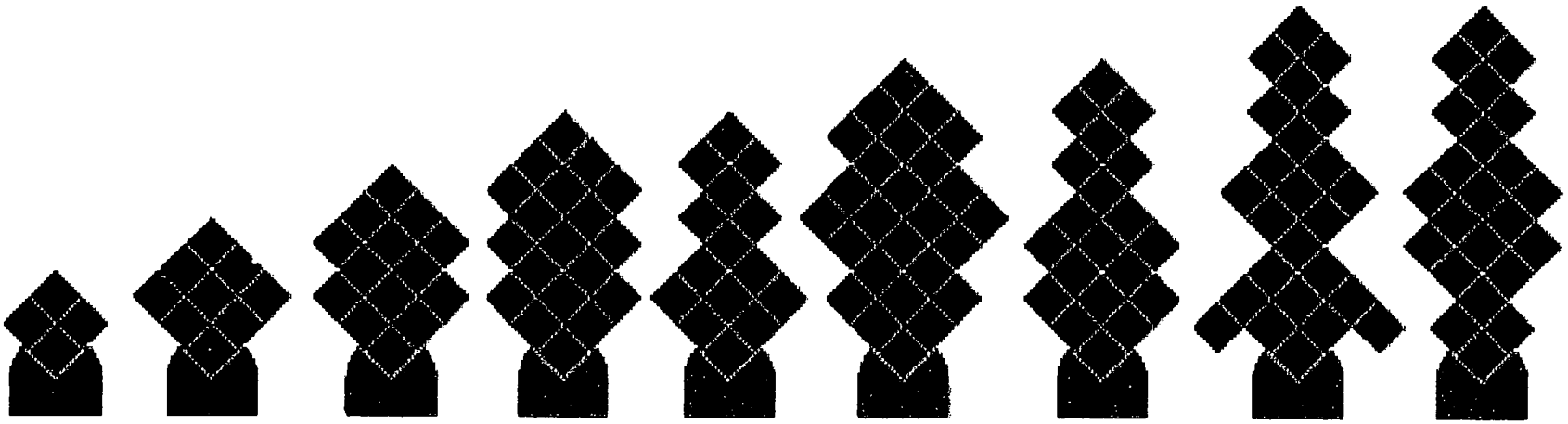
FIG. 4 is a schematic representation of some of the symmetric structures that can be built with the parts of the present puzzle.

The base member 12 has a planar bottom 34 which is intended to be placed on a flat substantially horizontal surface so as to be arranged as shown in FIGS. 2-4. The upper part of the base 12 has sloping walls 36 and 38 forming a V having a 90 degree angle between them. In the preferred embodiment, each wall 36 and 38 is arranged to be at the same angle from the horizontal so that the V opens directly upwardly. It is possible, however that the V could be tilted slightly to one side or the other as long as the 90 degree angle between the walls is retained. The length of the walls 36 and 38 are greater than the side of any one of the cubes making up the puzzle pieces 14-32 but is less than twice the length thereof. Preferably, the length of the walls 36 and 38 are one and one quarter times the length of one of the sides of a cube.

The balancing construction puzzle 10 of the present invention is utilized as illustrated in FIGS. 2-4. After the base 12 is placed in position on a flat surface, one of the puzzle parts 14-32 is placed in the V at the top thereof defined by the walls 36 and 38. For example, puzzle piece 30 is shown in FIG. 2 placed on the wall 36 with its bottom resting on the wall 38. Thereafter, a second puzzle piece such as, for example, piece 28 is placed against the first piece 30 and rests on the remaining portion of the upper part of the wall 38 of the base 12. As pointed out above, the walls 36 and 38 are longer than the length of a single cube. This allows for the creation of many more different structures than would be possible if the walls 36 and/or 38 were the same length as a single cube. Thus, the puzzle can be started with two pieces as just described or with a single piece that fills the surfaces of both walls. In either case, the puzzle then continues by adding additional parts such as shown in FIG. 3.

In the preferred embodiment of the invention, an attempt is made to construct symmetrical structures such as shown in FIG. 4. At all times, all of the puzzle pieces placed on the base 12 must balance and remain in position. Furthermore, in the preferred embodiment of the invention, the puzzle pieces are put in place so as to build in two dimensions only. Thus, and as shown in FIGS. 2 and 3, the assembled puzzle will always lie in a single plane.

Although the puzzle pieces themselves can be molded or carved from wood or substantially any other material, it is preferred to injection mold them. Furthermore, it is possible to produce all of the puzzle pieces 14-32 utilizing a single and relatively simple mold. As shown in FIG. 5, each half cube

40*a* can first be produced. If a single cube such as component 32 is being produced, all that is required is to put a second half cube 40*b* on the top thereof. A snap or interference fit can be provided to secure the two half cubes together. If, on the other hand, it is desired to make one of the other multiple cube pieces, two half cubes can be placed next to each other and connected utilizing a connector such as shown as 42. Thereafter, when the top cube halves 40*b* are placed down onto the lower cube halves 40*a*, the connectors 42 hold the pieces together.

The present invention may be embodied in other specific forms without departing from the spirit or essential attributes thereof and accordingly, reference should be made to the claims to be appended rather than to the foregoing specification as indicating the scope of the invention.

I claim:

1. A construction and balancing puzzle comprising:

at least one first type puzzle piece, said first type puzzle piece being substantially in the form of a cube and having a length, a width and a depth and wherein said length and width are equal;

a plurality of second type puzzle pieces, each of said second type puzzle pieces having a depth that is equal to the depth of said first type puzzle piece and having portions having lengths that are whole multiples of the length of said first type puzzle piece, and a base member having a depth substantially equal to the depth of said puzzle pieces, said base member having a planar bottom adapted to rest on a flat support surface and two upwardly facing walls, said walls being connected and forming a V between them with an angle of 90 degrees and the length of said walls being equal to each other, wherein the length of said walls of said base are greater than the length of said first type puzzle piece but less than twice the length of the length of said first type puzzle piece and said puzzle pieces are capable of being supported on said base member and then on each other to form a completed puzzle construction in a single vertically extending plane.

2. The construction and balancing puzzle as claimed in claim 1 wherein the length of said walls of said base are one and one-half the length of said first type puzzle piece.

3. The construction and balancing puzzle as claimed in claim 1 wherein each of said puzzle pieces is molded from plastic.

4. The construction and balancing puzzle as claimed in claim 3 wherein each of said second type puzzle pieces is made from a plurality of first type puzzle pieces joined together.

* * * * *